US006008765A

United States Patent [19]

Davidson et al.

[11] Patent Number: 6,008,765

[45] Date of Patent: Dec. 28, 1999

[54] RETRACTABLE TOP LOAD ANTENNA

[75] Inventors: Brian James Davidson; Stephen Goodwin, both of Surrey, United Kingdom

[73] Assignee: Nokia Mobile Phones Limited, Espoo, Finland

[21] Appl. No.: 08/892,017

[22] Filed: Jul. 14, 1997

Related U.S. Application Data

[63] Continuation of application No. 08/574,865, Dec. 19, 1995, abandoned.

[30] Foreign Application Priority Data

Dec. 23, 1994 [GB] United Kingdom ..... 9426229

[51] Int. Cl.[6] ..... H01Q 1/24

[52] U.S. Cl. ..... 343/702; 343/752

[58] Field of Search ..... 343/702, 900, 343/901, 903, 752; H01Q 1/24

[56] References Cited

U.S. PATENT DOCUMENTS

| | | | |
|---|---|---|---|
| 4,121,218 | 10/1978 | Irwin et al. | 343/702 |
| 4,868,576 | 9/1989 | Johnson, Jr. | 343/702 |
| 4,998,078 | 3/1991 | Hulkko | 333/109 |
| 5,138,329 | 8/1992 | Saarnimo et al. | 343/702 |
| 5,374,937 | 12/1994 | Tsunekawa et al. | 343/702 |
| 5,467,096 | 11/1995 | Takamoro et al. | 343/702 |

FOREIGN PATENT DOCUMENTS

| | | | |
|---|---|---|---|
| 508836 | 10/1992 | European Pat. Off. | H01Q 1/24 |
| 0613207 | 8/1994 | European Pat. Off. . | |
| 2253949 | 9/1992 | United Kingdom . | |
| 2275369 | 8/1994 | United Kingdom . | |
| WO 92/16980 | 10/1992 | WIPO . | |

*Primary Examiner*—Michael C. Wimer
*Attorney, Agent, or Firm*—Perma & Green, LLP

[57] ABSTRACT

An antenna assembly comprises an elongate antenna element (11) mounted in a support (5) and movable between a retracted position and an extended position. A helical antenna element (12) in electrical contact with the helical element is carried at one end of the elongate element. The coupling between the feed point and the antenna in the retracted and extended positions allow the same matching circuitry to be used in both conditions. The invention provides a compact and convenient dual antenna arrangement ideally suited for use in a portable cellular radio telephone.

24 Claims, 4 Drawing Sheets

RETRACTABLE TOP LOAD ANTENNA

This application is a continuation of application Ser. No. 08/574,865 filed on Dec. 19, 1995 abandoned.

BACKGROUND OF THE INVENTION

The invention relates to an antenna assembly having a retractable antenna comprising a helical antenna element carried by an elongate antenna element which may be applied, for example, to a portable radio and, in particular to a hand portable radio telephone.

Retractable antennas are of particular benefit in portable radio telephones as they enable the telephone to be conveniently carried by a user when the antenna is in the retracted position while providing appropriate operating characteristics in both the retracted and the extended positions.

U.S. Pat. No. 4,868,576 describes an antenna for a portable cellular telephone comprising a helical coil at the base of a retractable elongate radiating element. The retractable element which extends through the helical coil, has non-conductive portions at its two ends whereby the elongate element is capacitatively coupled to the helical coil, and in the retracted position the elongate element is substantially decoupled therefrom. The helical coil is fixedly mounted on the housing of the radio transceiver.

Another type of retractable antenna is described in copending patent application No. 9115134.0 entitled Retractable Antenna with Helical End. In the antenna disclosed in this application the helical element is carried by the elongate element. Antennas of this type provide for satisfactory performance with the antenna retracted for stand-by operation with better sensitivity and range performance during normal use with the antenna extended.

To provide the proper matching, the elongate element and the helical element are electrically isolated. This enables matching networks to be provided to ensure that the characteristic impedance to the feed point is the same when the antenna is retracted and extended. The matching network includes a coaxial feed that supplies both the extended and the retracted antenna, the elongate antenna providing the central conductor of the coaxial feed when in the retracted condition. In this solution there are currents flowing within the case of the portable telephone when the antenna is retracted which create stray fields that might interfere with correct circuit operation.

In addition to the unwelcome currents flowing in the case, ensuring electrical isolation between the helical and elongate element is wasteful of resources in that the additional gain that the helical portion of the antenna could provide in the extended position is not utilised. The electrical isolation would normally be created by an air gap between the two elements. This can also create a weakness in the antenna at the junction between the component elements making it less robust when extended.

SUMMARY OF THE INVENTION

In accordance with the present invention there is provided an antenna assembly comprising an elongate antenna element mounted in a support and movable between a retracted position and an extended position, a helical antenna element in electrical contact with, and carried by, the elongate antenna element, means for feeding the elongate antenna in the extended position from an end remote from the helical antenna, means for grounding the helical antenna in the retracted position at a ground point adjacent the elongate antenna element such that currents are substantially inhibited in the elongate element, and means for feeding the helical element in the retracted position.

By grounding the helical element at the end adjacent the elongate element, stray currents on the elongate element in the retracted position are substantially avoided. This ensures that fields within the casing are reduced and consequently there is a reduced interference with proper operation of the telephone circuitry.

The means for grounding the helical antenna may ground the helical antenna at a position approaching the end of the elongate antenna adjacent the helical element. The closer the grounding point is to the top of the elongate antenna, the shorter the distance currents can travel on the eleongate element within the casing. As a result, stray fields are correspondingly reduced.

The elongate antenna is preferably further grounded in the retracted position at the end remote from the helical element shown in drawings. This provides an additional ground to further inhibit stray currents in the elongate element and the consequent stray fields.

The helical element is preferably fed via a reactive coupling in the retracted position. This enables the impedance at the feed position in the retracted and the extended positions to be substantially equivalent. The exact nature of the reactive coupling can be adjusted to suit a particular antenna. By using a different coupling from the feed point to the antenna in the extended and retracted positions, the matching impedance can be kept the same in both situations allowing the helical element to be electrically coupled to the elongate element. This increases the gain of the antenna in the extended condition over an antenna of commensurate dimensions in which the helical and elongate elements are electrically isolated. In addition, using the same matching network can reduce the number of components of the antenna assembly reducing cost and providing less size restraints allowing the design to be more compact.

The reactive coupling may be a tap coupled to a tapping point on the helical element. A further reactive shunt element may be necessary at the feed point for the retracted antenna in order to attain a match. The actual element for a particular antenna can be chosen to allow discrepancies in the impedance between the retracted and extended positions to be tuned out.

The reactive coupling is preferably only used to feed the antenna in the retracted position. However, the same feed point is preferably used to feed the antenna in both positions.

One manner in which the impedance can be matched with the antenna in each of the positions is by using a capacitative shunt. This may be provided by an insulative member fixed relative to the support to form a coaxial system. RF signals are fed onto an outer conductor. The inner conductor which is the elongate antenna is grounded and a capacitance is thus formed to earth. A conductive member coupled to and carried by the helical element is coupled to the outer conductor of the coaxial system in the retracted position. In the extended position there is no coupling between the conductive member and the outer conductor of the coaxial system and so the helical element is not fed via the tapping point. This arrangement has the advantage that the feeding arrangement is changed as a result of moving the antenna between the extended and retracted positions.

The conductive member may be configured to form a collet depending from the helical element. One of other options is that the conductive member is a spring loaded pin biased for contact with the outer conductor of the coaxial system when in the retracted position.

The reactive coupling may include a second helical element insulated from and wound in the opposite sense to the first helical element. This provides the additional advantage that the reduction in radiation in the retracted case, that would otherwise result from the opposite polarisation of the current feeding the helical element and the current flowing in the helical element below the tapping point, is somewhat reduced.

Another way in which the problem associated with field cancellation below the tapping point can be reduced is by winding the helical element more tightly below the tap such that the non radiating length of the helical element resulting from the feed point of the helical in the retraced position is reduced.

It is noted that the term 'elongate antenna element' as used herein encompasses, for example, a rod type antenna or a coil type antenna having a generally elongate configuration. Also the term 'helical' is not restricted to a helix having a uniform diameter but is intended to include a coil having a progressively widening diameter, viz. a spiral configuration.

BRIEF DESCRIPTION OF THE DRAWINGS

The invention will now be described in greater detail with reference to FIGS. 1 to 6 of the drawings of which.

DETAILED DESCRIPTION OF THE INVENTION

Figure 1:
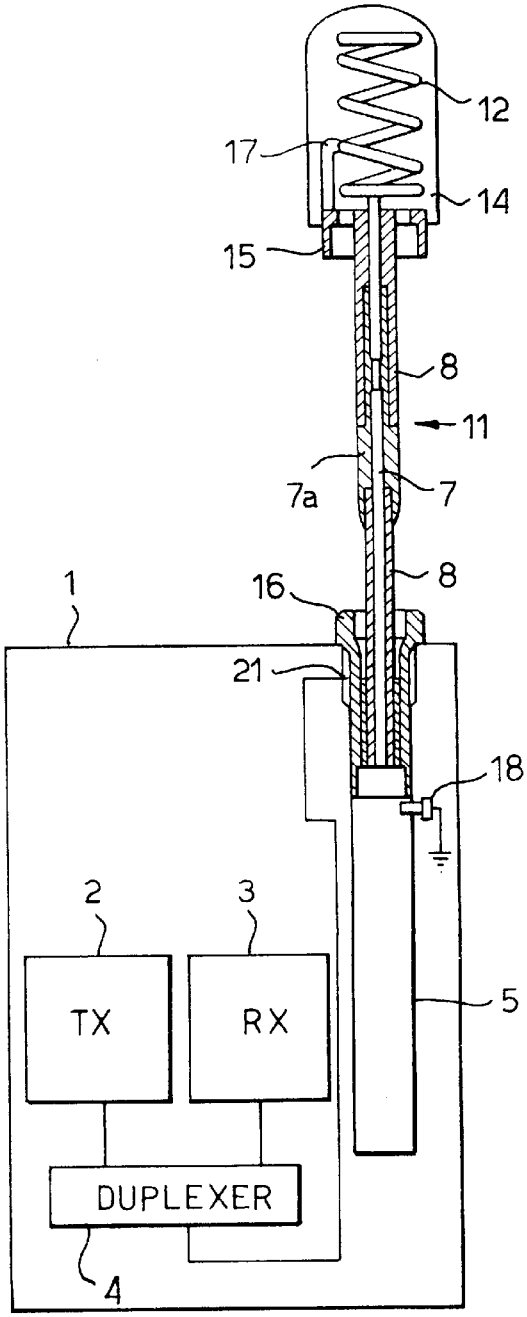
FIG. 1 is a schematic representation of an antenna arrangement in accordance with an embodiment of the invention, in situ in a portable telephone, antenna extended.
Figure 2:
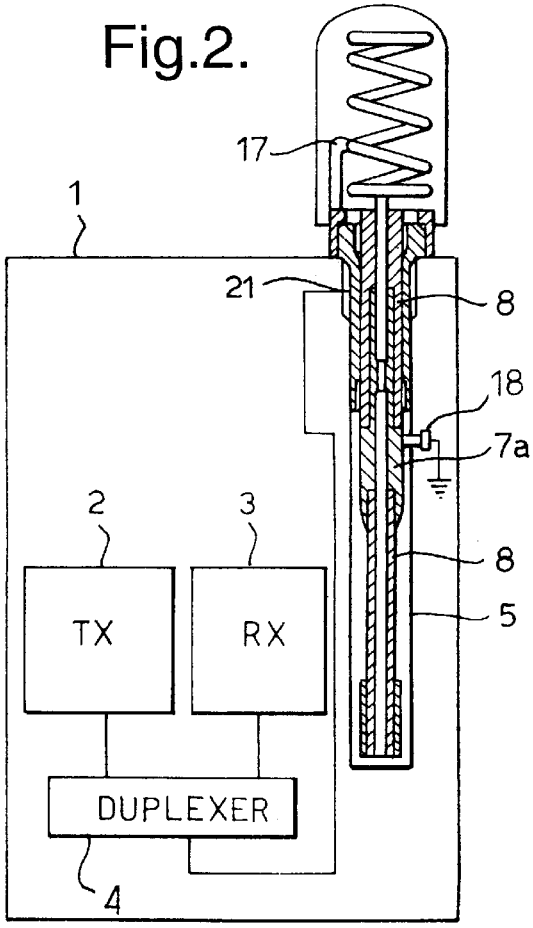
FIG. 2 is a schematic representation of the embodiment of FIG. 1 antenna retracted.

The radio telephone shown in the Figures comprises a housing 1 enclosing a conventional transmitter 2 and receiver 3 coupled respectively via a duplexer 4 to the antenna assembly.

The housing 1 also encloses all the other features conventionally found in a portable cellular telephone. Since these aspects are not directly relevant to the instant invention no further details will be given here.

The antenna assembly, provided adjacent the top face of the radio housing 1, comprises a support 5 in the form of a tube. This provides a guide for retraction and extension of the antenna.

The antenna assembly comprises two distinct antenna elements, namely an elongate antenna element 11 and a helical element 12. The elongate element comprises a central conductor 7 which may be a solid rod antenna or, alternatively, may be in the form of a close-wound coil which not only enhances flexibility of the elongate element and so reduces the risk of breakage, but also reduces the physical length of the antenna. The coil may be made of silver plated beryllium-copper wire. The elongate antenna element 11 may be chosen to have an equivalent electrical length, for example, one quarter of a wavelength. The conducting portion 7 of the elongate element 11 is enclosed within an insulating sleeve 8 made for example from a flexible plastics material. A further conductive sleeve 7*a* allows the conducting portion 7 to be grounded in the retracted position.

The end of the elongate antenna element 11 remote from the support 5 carries a helical antenna element 12. The helical coil 12 is very compact and has a short physical length but is wider in diameter than the elongate antenna element 11. The effective electrical length of the helical antenna element 12 is, for example, one quarter of a wavelength. The helical coil 12 is embedded in a dome-shaped dielectric encapsulation 14.

The helical antenna element 12 is permanently electrically connected to the conducting portion 7 of the elongate antenna element 11 to provide additional gain when the antenna is extended. The elongate antenna 11 is, for example, quarter of a wavelength to provide a ⅜–⅝ antenna. The lower end of the helical coil 12 is also electrically connected to a contact member in the form of a collet 15 which protrudes from the underside of the encapsulation 14. A complementary conductive collet 16 is provided on the support 5. In the retracted position the elongate antenna element is substantially entirely enclosed within the casing of the phone. It slides within the support 5 to maintain a proper position within the phone. This can take the form of an earth plate or other suitable connection.

In the retracted position, the collet 15 depending from the helical antenna element 12 engages the complementary collet 16. The insulating sleeve 8 provided between the collet 16 and the conducting portion 7 together with the conducting collet 16 provides a transmission line for feeding the helical element in the retracted position. The material and thickness of the insulating sleeve is chosen to provide a desired capacitance to earth. A tap 17 is provided to couple the complementary collet and the helical element at a position remote from the base of the helical element. A ground contact 18 is made to the conductive sleeve 7*a* of the elongate antenna element which is thus rendered inactive as a radiating element when in the retracted position.

When the antenna is extended, the ground contact 18 floats and the conducting portion 7 of the elongate element is fed through the collet 16. As the helical element 12 is in electrical contact with the conducting portion 7 of the elongate element, it too is fed via the collet 16 and the conductive portion 7 in this position.

The choice of the position of the tap and the capacitance to earth for the transmission line feeding the helical element of the antenna in the retracted position enables the same impedance parameters to be achieved for both the extended and the retracted cases.

If the collet 15 is relatively widely spaced from the internal conductor 7 this reduces problems associated with capacitance between the collet 15 and the internal conductor 7 when extended.

Figure 3:
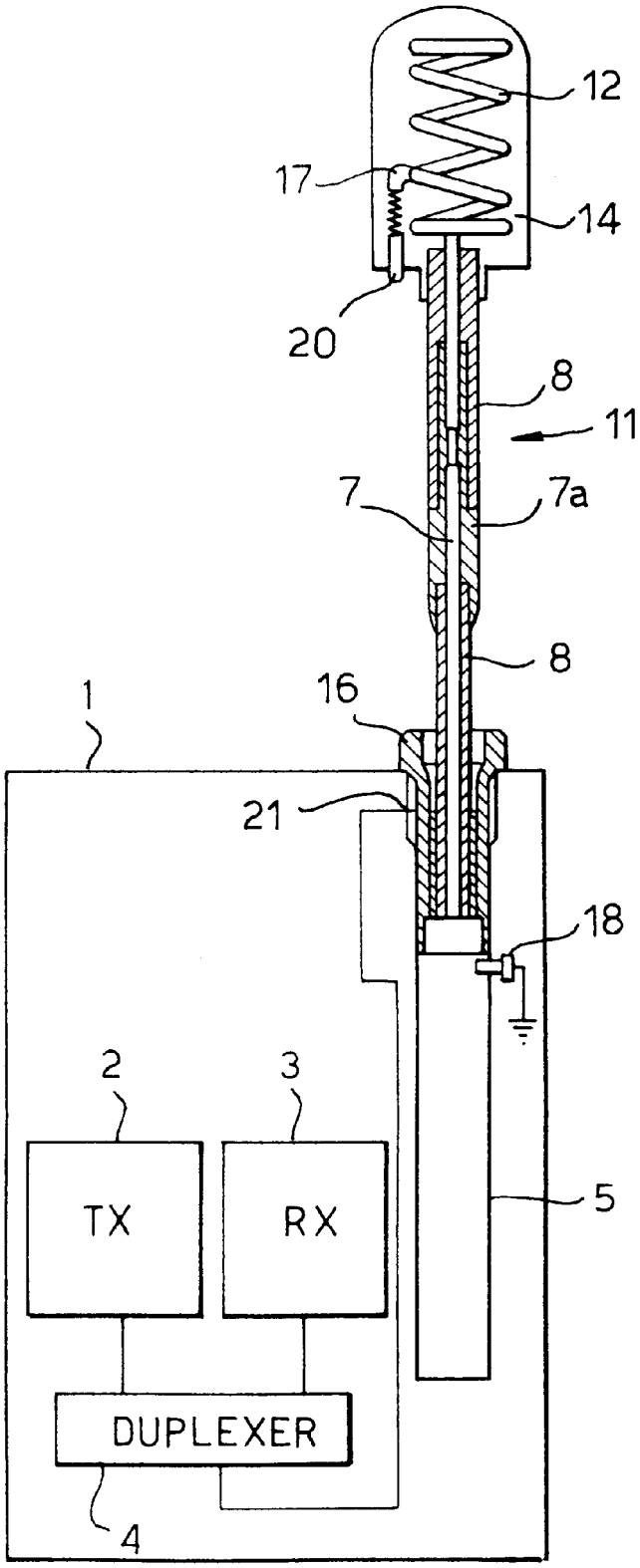
FIG. 3 is schematic representation of another embodiment of the invention, antenna extended.

To reduce the problems with this capacitance still further the connection between the complementary collet 16, the collet 15 can be replaced with a spring loaded pin 20 as shown in FIG. 3. The spring loaded pin 20 makes contact with the complementary collet 16 and feeds the tap 17 on the helical element when the antenna is in the retracted position.

The input impedance $Z_i$ of the antenna is substantially the same when the elongate antenna element is respectively extended and retracted despite the different nature of the antenna in the two cases. The antenna is fed through the same feed point 21 regardless of whether the antenna is extended or retracted. Since the helical antenna element 12 is connected to the conductive element 7 of the elongate antenna element 11 both elements are functionally active as a combined antenna in the extended position providing gain advantages.

Figure 4A:
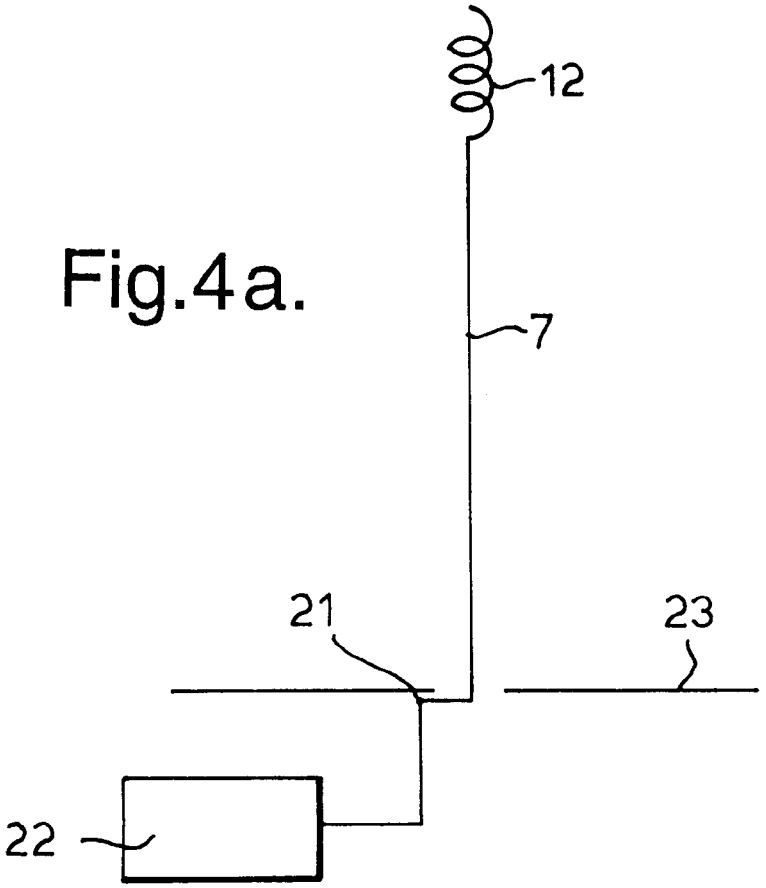
FIGS. 4*a* and 4*b* provide schematic representations of the embodiment of FIG. 1 with the antenna respectively extended and retracted.
Figure 4B:
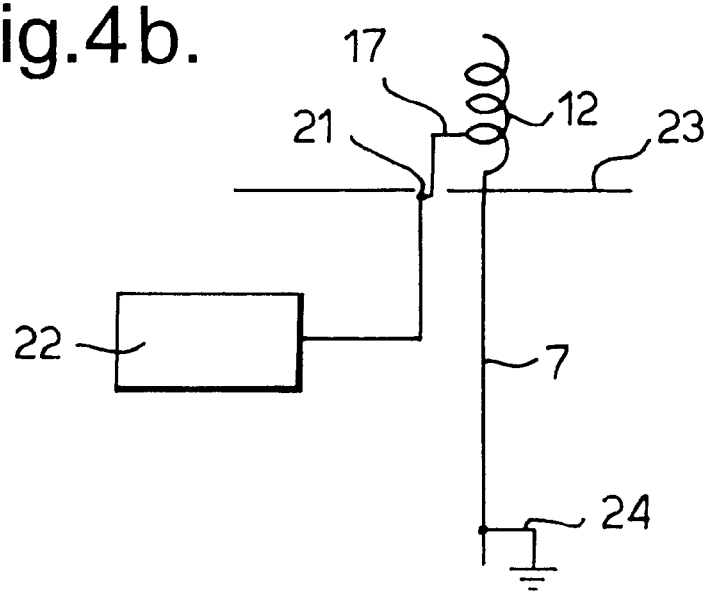

FIGS. 4*a* and 4*b* illustrate the electrical connections made to the matching circuitry in the extended and retracted positions. In the extended position (FIG. 4*a*) the antenna is connected to the feed point 21 of RF circuitry 22 at the end remote from the helical element. In the retracted position (FIG. 4*b*), the feed point 21 feeds and receives RF signals to the helical element via the tap 17. The elongate antenna is grounded by a ground plate 23 near to its top. The elongate element is also grounded 24 at the end remote from the helical element.

Figure 5:
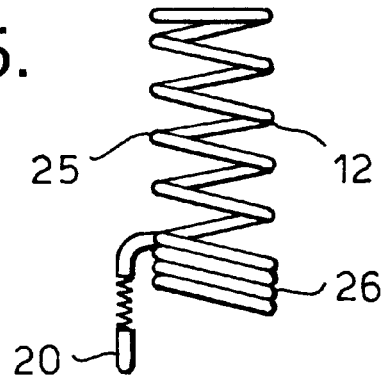
FIG. 5 is a schematic representation of a helical element of an embodiment of the invention.

In the retracted case the helix does not radiate as well with the tap as it would without it. This is because the component of current in the helical element flowing in the direction of the elongate antenna below the tapping point 17 and the current flowing in the tap itself are opposite in polarity and cancel to some extent. In order, to reduce the 'non-radiating length' ie the part causing destructive interference, the turns of the helix below 26 the tapping point 17 are wound more tightly than those above 25 the tapping point 17. This can be seen in FIG. 5.

Figure 6:
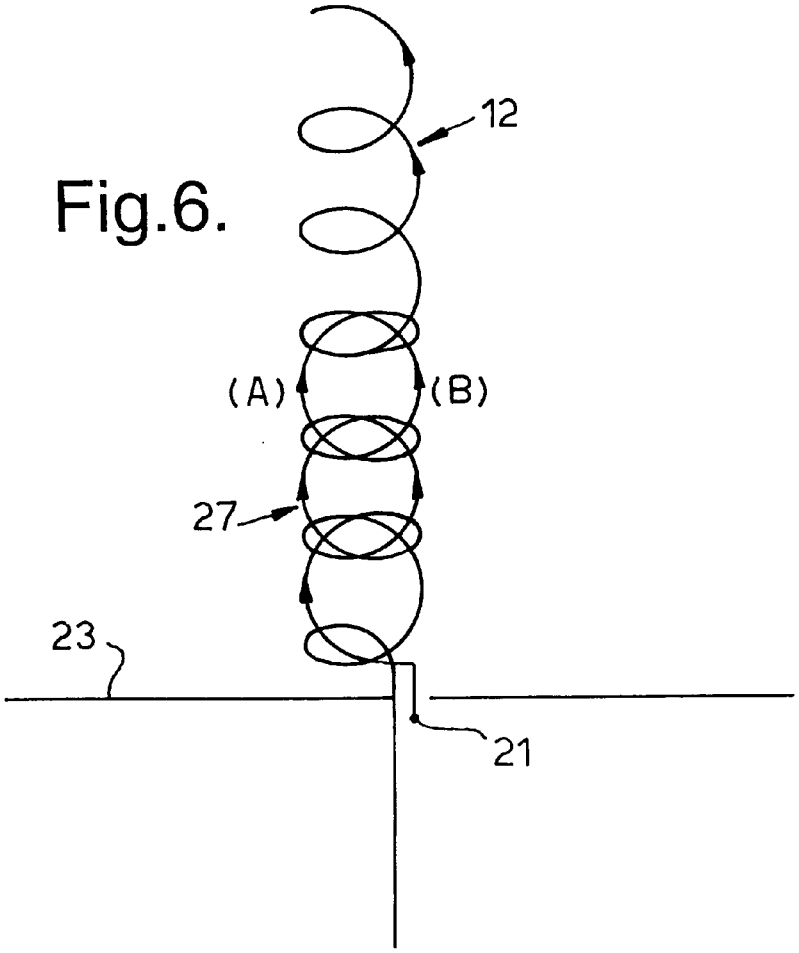
FIG. 6 is a schematic representation of an embodiment of the invention antenna retracted.

FIG. 6 shows another embodiment of the invention. A second helical antenna element 27 is provided between the feed point 21 in the retracted position and the helical antenna element 12. This second helix 27 is insulated from, and wound in the opposite sense to, the helical element 12 connected to the conductive element 7 of the elongate antenna element 11. The current flowing in the second helix 27 in the direction of the elongate element (A) induces a current in the helical element 2 in that same direction (B). The components of the current in the direction of the elongate element therefore add in phase. Since it is this component which gives the predominant radiation resistance in normal mode, this also improves radiation from the helical element 12 in the retracted case.

The present invention includes any novel feature or combination of features disclosed herein either explicitly or implicitly irrespective of whether or not it relates to the claimed invention or mitigates any or all of the problems addressed.

In view of the foregoing description it will be evident to a person skilled in the art that various modifications may be made within the scope of the present invention.

What is claimed is:

1. An antenna assembly comprising an elongate antenna element mounted in a support and movable between a retracted position and an extended position, a helical antenna element in electrical contact with, and carried by, the elongate antenna element, means for feeding the elongate antenna element in the extended position from an end remote from the helical antenna element, means for grounding the helical antenna element in the retracted position at a ground point adjacent the elongate antenna element such that currents are substantially inhibited in the elongate antenna element in the retracted position, and means for feeding the helical antenna element in the retracted position, wherein the means for grounding the helical antenna element comprises means for coupling the elongate antenna element to ground at a position approaching the end of the elongate antenna element adjacent the helical antenna element.

2. An antenna assembly according to claim 1 wherein the means for feeding the helical element comprises a reactive coupling such that the impedance at a feed point in the retracted and the extended positions is substantially equivalent.

3. An antenna assembly according to claim 2 wherein signals are fed to and received from the feed point in both the retracted and extended positions.

4. An antenna assembly according to claim 2 wherein the reactive coupling is an inductive coupling.

5. An antenna according to claim 2 wherein the reactive coupling comprises a tap coupled to a tapping point on the helical element.

6. An antenna assembly according to claim 5 wherein the helical element is wound more tightly below the tapping point.

7. An antenna assembly according to claim 2 wherein the reactive coupling comprises a second helical element wound in the opposite sense to the helical antenna element.

8. An antenna assembly according to claim 2 wherein the reactive coupling comprises a conductive member carried by the helical element and wherein a cooperating conductive member carried by the support is arranged for coupling to the conductive member carried by the helical element in the retracted position.

9. An antenna according to claim 8 wherein the conductive member carried by the helical element is configured to form a collet depending from the helical element.

10. An antenna assembly according claim 8 wherein the conductive member carried by the helical element is a spring loaded pin.

11. An antenna assembly according to claim 2 wherein a capacitance to ground is provided in parallel with the reactive coupling.

12. An antenna assembly according to claim 11 wherein the capacitance to ground is provided by a coaxial transmission line with the central conductor grounded and the outer conductor coupled to the reactive coupling.

13. An antenna assembly according to claim 2 wherein the elongate antenna element is further grounded in the retracted position at the end remote from the helical element.

14. An antenna assembly as in claim 1 wherein the means for feeding includes only a single feed (21) to the antenna assembly.

15. An antenna assembly comprising an elongate antenna element mounted movable between a retracted position and an extended position, a helical antenna element in electrical contact with, and carried by, the elongate antenna element, means for feeding the elongate antenna element in the extended position from an end remote from the helical antenna element, means for grounding the helical antenna element in the retracted position at a ground point adjacent the elongate antenna element such that currents are substantially inhibited in the elongate element in the retracted position, and means for feeding the helical element in the retracted position, wherein the means for feeding the helical element comprises a reactive coupling such that the impedance at a feed point in the retracted and the extended positions is substantially equivalent, and wherein the reactive coupling comprises a conductive member carried by the helical element and wherein a cooperating conductive member carried by a support for the antenna assembly is arranged for coupling to the conductive member carried by the helical element in the retracted position.

16. A radio telephone comprising:

a housing;

electronic circuitry located inside the housing, the circuitry including a transmitter and a receiver, and an antenna assembly movably mounted to the housing and electrically connected to the circuitry, the antenna assembly having an elongate antenna element and a helical antenna element, the helical antenna element being electrically connected to and mechanically carried by the elongate antenna element, wherein when the antenna assembly is in a retracted position relative to the housing, the helical antenna element is grounded by a ground point coupled to the elongate element at a position approaching an end of the elongate antenna element adjacent the helical antenna element.

17. A radio telephone as in claim 16 further comprising a second ground point that connects to the elongate antenna element, when the elongate element is in its retracted position, at an end of the elongate antenna element remote from the helical antenna element.

18. A radio telephone as in claim 16 wherein the helical antenna element has turns located below a tapping feed point that are wound more tightly than turns of the helical antenna element above the tapping feed point.

19. A radio telephone as in claim 16 wherein a feed for the helical antenna element is provided that comprises a reactive coupling such that impedance of the feed is substantially equivalent at the retracted position and an extended position.

20. A radio telephone as in claim 19 wherein the reactive coupling comprises a conductive member carried by the helical element and wherein a cooperating conductive member carried by the housing is arranged for coupling to the conductive member carried by the helical element in the retracted position.

21. An antenna assembly comprising an elongate antenna element mounted in a support and movable between a retracted position and an extended position, a helical antenna element in electrical contact with, and carried by, the elongate antenna element, means for feeding the elongate antenna element in the extended position from an end remote from the helical antenna element, means for grounding the helical antenna element in the retracted position at a ground point adjacent the elongate antenna element such that currents are substantially inhibited in the elongate element in the retracted position, and means for feeding the helical element in the retracted position, wherein the means for grounding the helical antenna element comprises means for coupling the elongate antenna element to ground at a position approaching the end of the elongate antenna element adjacent the helical element, wherein the means for feeding the helical element comprises a reactive coupling such that the impedance at a feed point in the retracted and the extended positions is substantially equivalent, and wherein the reactive coupling comprises a conductive member carried by the helical element and wherein a cooperating conductive member carried by the support is arranged for coupling to the conductive member carried by the helical element in the retracted position.

22. A radio telephone comprising:

a housing;

electronic circuitry located inside the housing, the circuitry including a transmitter and a receiver; and an antenna assembly movably mounted to the housing and electrically connected to the circuitry, the antenna assembly having an elongate antenna element and a helical antenna element, the helical antenna element being electrically connected to and mechanically carried by the elongate antenna element, wherein when the antenna assembly is in a retracted position relative to the housing, the helical antenna element is grounded by a ground point coupled to the elongate antenna element at a position approaching an end of the elongate antenna element adjacent the helical antenna element, and further comprising a second ground point that connects to the elongate antenna element, when the elongate element is in its retracted position, at an end of the elongate antenna element remote from the helical antenna element.

23. A radio telephone comprising:

a housing;

electronic circuitry located inside the housing, the circuitry including a transmitter and a receiver; and an antenna assembly movably mounted to the housing and electrically connected to the circuitry, the antenna assembly having an elongate antenna element and a helical antenna element, the helical antenna element being electrically connected to and mechanically carried by the elongate antenna element, wherein when the antenna assembly is in a retracted position relative to the housing, the helical antenna element is grounded by a ground point coupled to the elongate antenna element at a position approaching an end of the elongate antenna element adjacent the helical antenna element, wherein a feed for the helical antenna element is provided that comprises a reactive coupling such that impedance of the feed is substantially equivalent at the retracted position and an extended position, wherein the reactive coupling comprises a conductive member carried by the helical element, and wherein a cooperating conductive member carried by the housing is arranged for coupling to the conductive member carried by the helical element in the retracted position.

24. A radio telephone comprising:

a housing;

electronic circuitry located inside the housing, the circuitry including a transmitter and a receiver; and an antenna assembly comprising an elongate antenna element mounted in a support and movable between a retracted position and an extended position, a helical antenna element in electrical contact with, and carried by, the elongate antenna element, means for feeding the elongate antenna element in the extended position from an end remote from the helical antenna element, means for grounding the helical antenna element in the retracted position at a ground point adjacent the elongate antenna element such that currents are substantially inhibited in the elongate antenna element in the retracted position, and means for feeding the helical antenna element in the retracted position, wherein the means for grounding the helical antenna element comprises means for coupling the elongate antenna element to ground at a position approaching the end of the elongate antenna element adjacent the helical antenna element.

* * * * *